US009719318B2

(12) United States Patent
Haake et al.

(10) Patent No.: US 9,719,318 B2
(45) Date of Patent: Aug. 1, 2017

(54) HIGH-TEMPERATURE, HIGH-PRESSURE, FLUID-TIGHT SEAL USING A SERIES OF ANNULAR RINGS

(71) Applicant: Halliburton Energy Services, Inc., Houston, TX (US)

(72) Inventors: Russell S. Haake, Dallas, TX (US); Mark Henry Strumpell, Allen, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 190 days.

(21) Appl. No.: 14/379,253

(22) PCT Filed: Jun. 12, 2013

(86) PCT No.: PCT/US2013/045307
§ 371 (c)(1),
(2) Date: Aug. 15, 2014

(87) PCT Pub. No.: WO2014/200469
PCT Pub. Date: Dec. 18, 2014

(65) Prior Publication Data

US 2016/0168946 A1 Jun. 16, 2016

(51) Int. Cl.

| | |
|---|---|
| ***E21B 31/107*** | (2006.01) |
| ***E21B 31/113*** | (2006.01) |
| ***E21B 33/128*** | (2006.01) |
| ***E21B 33/12*** | (2006.01) |
| ***E21B 21/06*** | (2006.01) |
| ***E21B 34/06*** | (2006.01) |

(52) U.S. Cl.
CPC ..... *E21B 33/1285* (2013.01); *E21B 21/062* (2013.01); *E21B 33/1212* (2013.01); *E21B 34/06* (2013.01)

(58) Field of Classification Search
CPC ... E21B 31/107; E21B 31/113; E21B 31/1135
USPC ..... 166/301, 178
See application file for complete search history.

(56) References Cited

U.S. PATENT DOCUMENTS

| | | | | |
|---|---|---|---|---|
| 3,221,826 | A * | 12/1965 | Webb | E21B 31/113 166/178 |
| 3,429,389 | A | 2/1969 | Barrington | |
| 3,570,612 | A * | 3/1971 | Slator | E21B 31/113 175/297 |
| 3,955,634 | A | 5/1976 | Slator et al. | |
| 4,109,736 | A * | 8/1978 | Webb | E21B 31/1135 175/297 |

(Continued)

OTHER PUBLICATIONS

International Search Report and Written Opinion dated Mar. 12, 2014 for Application No. PCT/US2013/045307.

*Primary Examiner* — Kenneth L Thompson
(74) *Attorney, Agent, or Firm* — Chamberlain Hrdlicka

(57) ABSTRACT

The invention is directed to a novel and useful fluid-tight, metal-to-metal, annular seal which can be repeatedly cycled in a high temperature, high pressure environment. More specifically, the invention provides a metal-to-metal, annular, seal on a radially expandable sliding sleeve which moves longitudinally from a reduced ID section of a bore to an enlarged section of the bore. The seal is disengaged at the enlarged bore section resulting in rapid fluid flow and pressure equalization which would destroy many traditional elastomer seals.

15 Claims, 4 Drawing Sheets

(56) References Cited

U.S. PATENT DOCUMENTS

| | | | | |
|---|---|---|---|---|
| 4,456,081 | A * | 6/1984 | Newman | E21B 31/113 175/297 |
| 4,771,831 | A | 9/1988 | Pringle et al. | |
| 4,846,273 | A * | 7/1989 | Anderson | E21B 31/107 166/178 |
| 5,211,226 | A | 5/1993 | Hendrickson et al. | |
| 8,657,007 | B1 * | 2/2014 | Watson | E21B 19/22 166/178 |
| 2011/0297254 | A1 | 12/2011 | Geddes | |

* cited by examiner

HIGH-TEMPERATURE, HIGH-PRESSURE, FLUID-TIGHT SEAL USING A SERIES OF ANNULAR RINGS

CROSS-REFERENCE TO RELATED APPLICATIONS

None.

BACKGROUND

The invention is directed to a novel and useful fluid-tight annular seal which can be repeatedly cycled in a high temperature, high pressure environment. More specifically, the invention provides a metal-to-metal, annular, sliding seal which moves longitudinally in a housing from a narrow bore section in which the seal is engaged, to a wider bore section in which the seal is released.

SUMMARY

Presented are methods and apparatus for repeatedly providing a metal-to-metal annular seal for use in extreme downhole conditions. In one embodiment, the apparatus is a sliding sleeve having a radially expandable thin-walled portion responsive to a pressure differential across the OD and ID of the sleeve. A fluid flow resistor, such as annular metal rings mounted in corresponding grooves on the exterior of the sleeve, provides fluid flow resistance along the OD of the sleeve. The resistors or rings are designed to be partial seals and provide predictable leakage. The use of numerous rings in series enhances the overall sealing ability, provides greater flow resistance, and reduces stresses on any single ring. This limited, gradual leakage prevents a pressure buildup in the OD annulus downstream of the rings. An annular pressure differential is created between the annulus on the OD of the sleeve and the annulus on the ID of the sleeve, thus causing the sleeve to expand. This sleeve expansion creates a fluid-tight, metal-to-metal seal shortly downstream of the rings. The sliding sleeve assembly, along with other components, such as a metering valve sleeve and impact mandrel, is pulled uphole and along the housing. When the annular, metal-to-metal seal reaches a point where the sealing ID on the housing is radially enlarged, the seal is broken. The metallic nature of the rings leaves them undamaged as they move along and as they return into the radially reduced sealing bore ID.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

Figure 1:
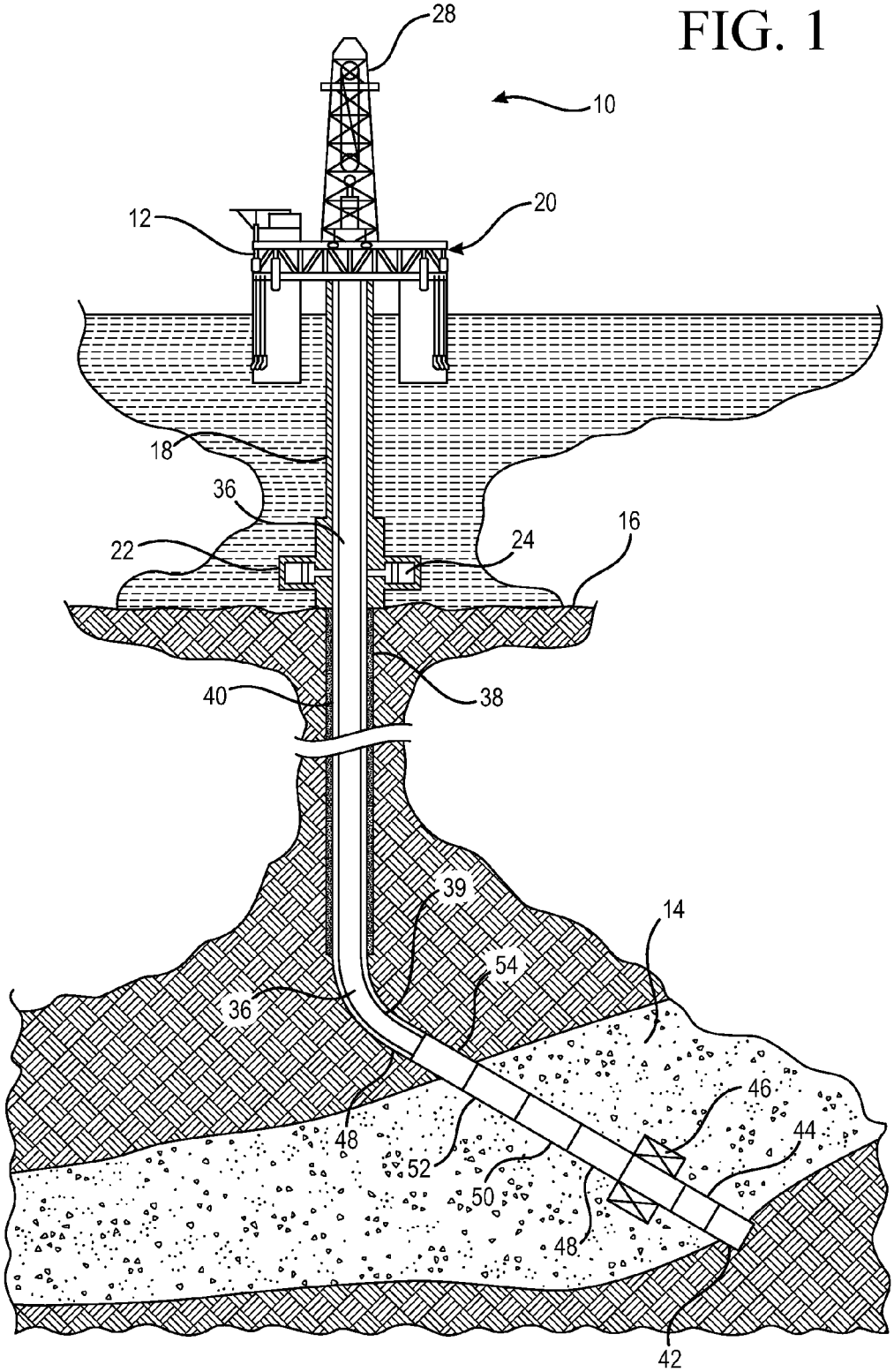
FIG. 1 is a schematic illustration of an exemplary offshore oil and gas platform having a work string extending through a wellbore, the work string including a downhole tool utilizing an annular seal apparatus according to an aspect of the invention.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention. The description is provided with reference to a vertical wellbore; however, the inventions disclosed herein can be used in horizontal, vertical or deviated wellbores. As used herein, the words "comprise," "have," "include," and all grammatical variations thereof are each intended to have an open, non-limiting meaning that does not exclude additional elements or steps. It should be understood that, as used herein, "first," "second," "third," etc., are arbitrarily assigned, merely differentiate between two or more items, and do not indicate sequence. Furthermore, the use of the term "first" does not require a "second," etc. The terms "uphole," "downhole," and the like, refer to movement or direction closer and farther, respectively, from the wellhead, irrespective of whether used in reference to a vertical, horizontal or deviated borehole. The terms "upstream" and "downstream" refer to the relative position or direction in relation to fluid flow, again irrespective of the borehole orientation. Although the description may focus on a particular means for positioning tools in the wellbore, such as a tubing string, coiled tubing, or wireline, those of skill in the art will recognize where alternate means can be utilized. As used herein, "upward" and "downward" and the like are used to indicate relative position of parts, or relative direction or movement, typically in regard to the orientation of the Figures, and does not exclude similar relative position, direction or movement where the orientation in-use differs from the orientation in the Figures.

The invention is directed to a novel and useful annular seal which can be repeatedly cycled without substantive performance degradation, even in high temperature, high pressure environments. More specifically, the invention provides a metal-to-metal, annular, sliding seal which moves longitudinally in a housing from a narrow ID bore section, in which the seal is engaged, to a wider ID bore section in which the seal is released. The design provides, preferably, for rapid pressure equalization upon release.

Without limiting the scope of the present invention, its background is described with reference to certain embodiments, especially for use in a pressure-balanced jar tool assembly. The inventions can be used in other tools and assemblies requiring a repeated-use, sliding seal providing a metal-to-metal seal. Those of skill in the art will recognize such applications and others.

FIG. 1 is a schematic illustration of an exemplary offshore oil and gas platform having a work string extending through a wellbore. The work string includes a downhole tool utilizing an annular seal according to an aspect of the invention and deployed from a platform generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 is generally designated and includes necessary and well-known apparatus, tools, etc., for operation of the platform, such as hoist, derrick 28, travel block, hook and swivel, and pipe stands. The platform is operable to raise and lower pipe strings, perform operations such as drilling, casing, testing, including drill stem testing, running and pulling tools, stimulation, fracturing, production, etc. An exemplary work string 36, being substantially tubular, extends axially into the wellbore 39.

Wellbore 39 extends through the various earth strata including formation 14. An upper portion of wellbore includes casing 40 that is cemented 38 within wellbore. Disposed in an open-hole portion of wellbore is an exemplary work string 36. It is understood that the inventions disclosed herein are not limited to use only in a work string configured as shown in FIG. 1, and that the inventions can be used on various tubing strings for various purposes. For example, the inventions can be used in various well operations, on tubing, production, completion, drilling strings, and the like. As used herein, "work string" is a generic term encompassing work strings, tubing strings, completion strings, production strings, injection and work-over strings, etc., as are known in the art.

The string 36 can include downhole tools, tubing, joints, collars and the like, in any configuration suitable to the purpose of the user. The exemplary string seen in FIG. 1 is shown having a bottom sub 42, a perforating tool assembly 44, a packer assembly 46, tubing 48, a pressure-balanced jar tool assembly 50, a sampler 52, and a valve assembly 54, such as a circulating or drain valve. Other tools, assemblies, etc., can be employed on the string.

Even though FIG. 1 depicts a slanted wellbore, it is understood by those skilled in the art that the apparatus and methods presented herein are suited for use in vertical wellbores, horizontal wellbores, multilateral wellbores, and the like. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it is understood by those skilled in the art that the apparatus and methods disclosed herein are suited for use in onshore operations. Further, even though FIG. 1 depicts an open-hole along a length of the wellbore, it is understood by those skilled in the art that the present invention is suited for use in a cased wellbore.

Figure 2A:
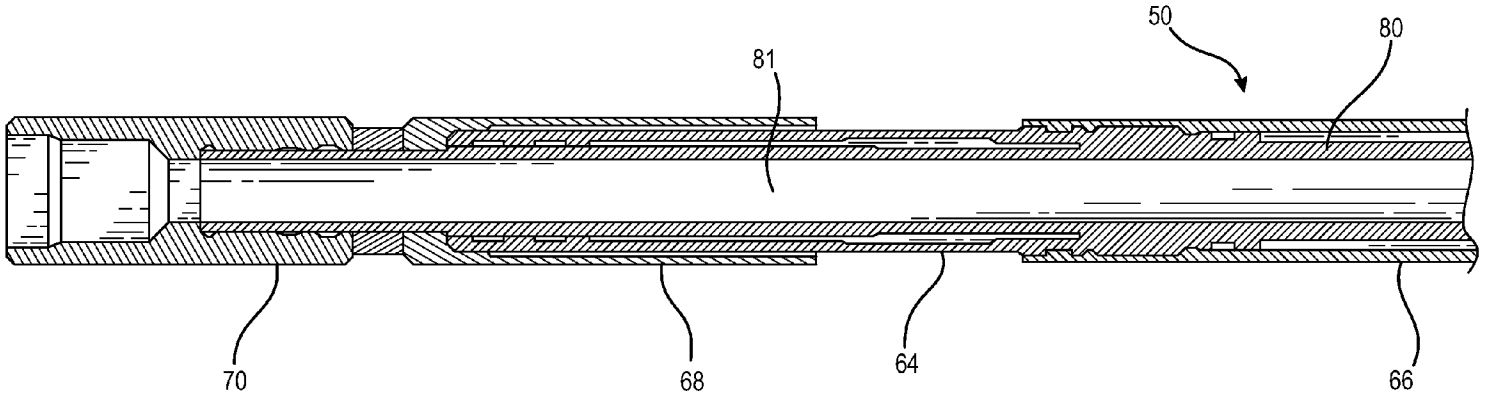
FIGS. 2A-2C are a schematic, cross-sectional and partial view of a jar tool assembly having an annular sliding sleeve seal assembly according to an aspect of the invention.
Figure 2B:
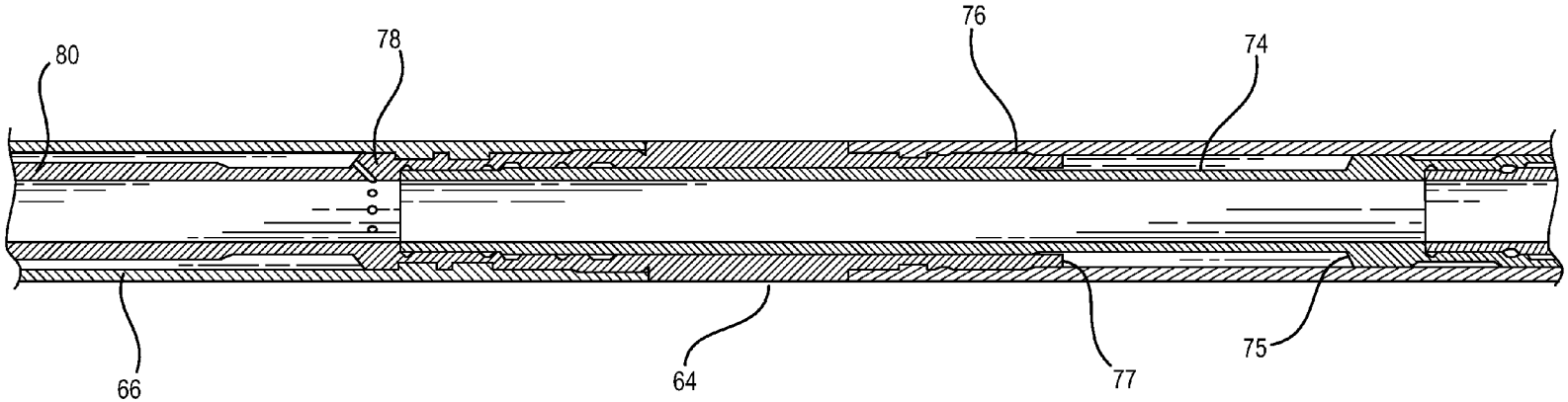
Figure 2C:
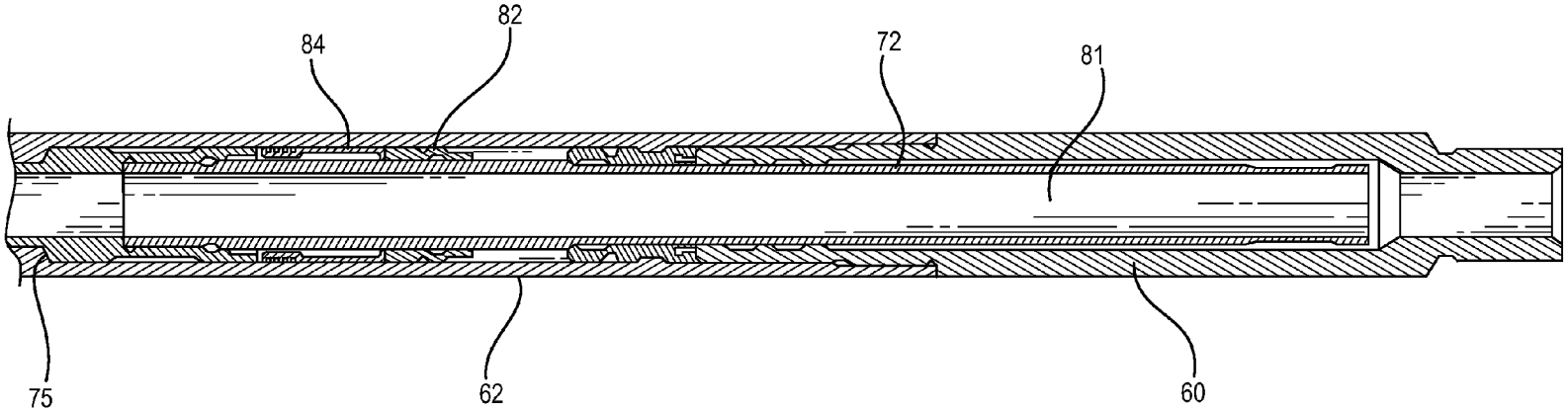

FIGS. 2A-2C are schematic, cross-sectional views of a pressure-balanced jar tool assembly, generally designated as 50, and having a sliding seal assembly according to an aspect of the invention. The jar tool assembly 50 would be positioned in a wellbore extending through a subterranean formation. The tool assembly shown as a schematic, and is exemplary only, lacking details, not to scale, etc.

In use, a jar tool is operated to release "stuck" well string. Tools below the jar tool assembly in the wellbore are stuck and prevent removal of the string from the wellbore. The pressure-balanced hydraulic jar tool assembly 50 is used to attempt to free the string by delivering an impact to the string. Should the first impact not free the string, the procedure is repeated multiple times until the string is freed or more drastic and costly measures must be employed. Not all of the operational steps will be described herein, as use of jar tools is known in the art. The description will focus on the novel apparatus and method of creating an annular metal-to-metal seal by hydraulic pressure, and which seal is suitable for use in high-temperature, high-pressure environments, and which can be repeatedly used without damage to the seal.

The pressure-balanced jar tool assembly 50 includes, generally, a bottom sub 60, a jar housing 62, joints 64, sealing case 66, adapter 68, and top sub 70. The tool assembly is configured for attachment, above and below to a work string and becomes a part of the work string. Each of these members has a substantially tubular exterior housing or surface and are assembled together for use. Mounted within the housings are a seal mandrel 72, which is connected to an impact mandrel 74, an impact nipple 76, a pressure-balance assembly 78 having cross-over ports, and an upper mandrel 80. As used in the art, sometimes "mandrel" refers to the collective whole of the various mandrels and their connections, as is understood by those of skill in the art; for example, the "mandrel" can be manipulated (pulled, placed weight-down, rotated or torqued, etc.) from the surface by the user. The mandrel or tool string refers to this collection of tools, spacers, connections, adapters, etc. The mandrel defines an interior passageway 81 for fluid flow. The impact mandrel 74 has, formed on its exterior surface, a shoulder 75, which impacts corresponding shoulder 77 of impact nipple 76.

Additionally, the assembly includes sleeve members, such as metering valve 82, and sliding sleeve seal assembly 84 mounted on the mandrel, between the mandrel and housing. The jar tool assembly is used in efforts to loosen and free stuck tools or tubing. For example, downhole from the bottom sub one or more tools or tubing sections may become stuck in the wellbore.

Figure 3:
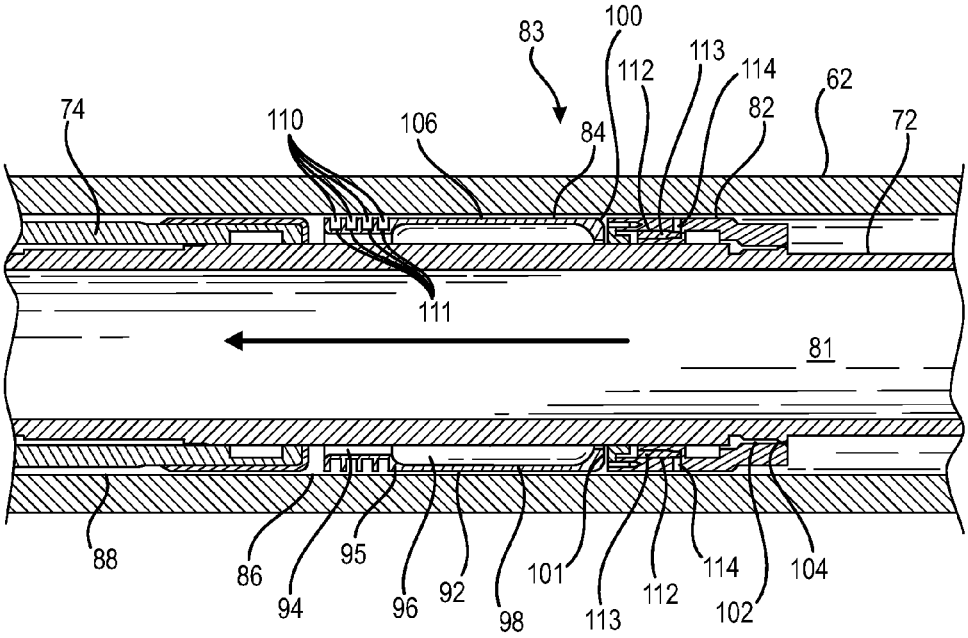
FIG. 3 is a detail, cross-sectional schematic view of an exemplary embodiment of a jarring tool and sliding sleeve assembly according to an aspect of the invention, seen in a first position.
Figure 4:
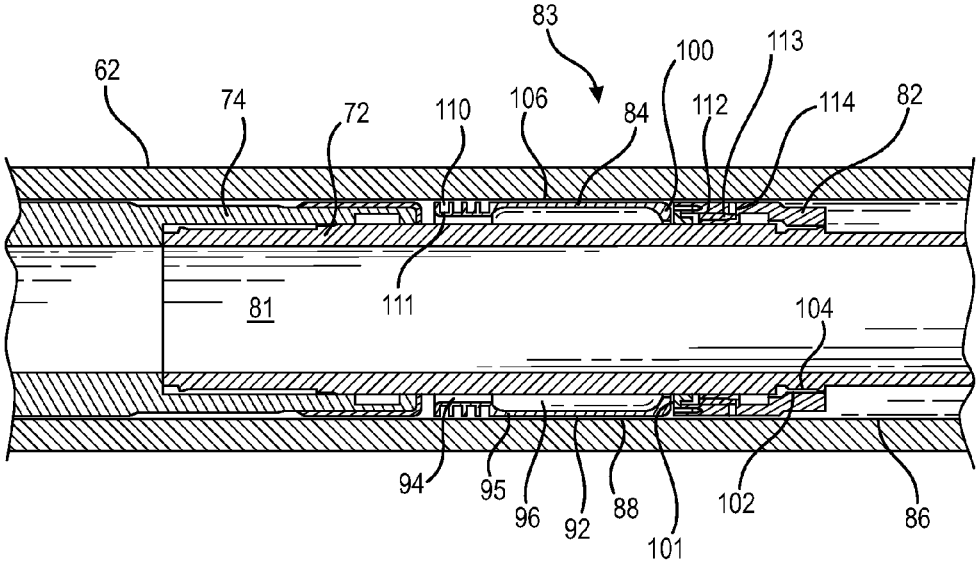
FIG. 4 is a detail, cross-sectional schematic view of the embodiment of a jarring tool and sliding sleeve assembly seen in FIG. 3, seen in a second position.

FIG. 3 is a cross-sectional, detail, schematic view of an exemplary sliding seal assembly in an initial position according to an aspect of the invention. FIG. 4 is a cross-sectional, detail, schematic view of an exemplary sliding seal assembly in an open position according to an aspect of the invention. FIGS. 3-4 are discussed together with like reference numbers used throughout.

In the preferred embodiment shown, the jar housing 62 forms a substantially tubular housing in which is positioned a substantially tubular seal mandrel 72. The seal mandrel 72 inner surface defines an interior passageway 81. The interior surface of the jar housing 62 defines a bore having a radially reduced portion 86 and a radially enlarged portion 88. The radially reduced portion has an ID smaller than that of the radially enlarged portion. Here, the terms "enlarged" and "reduced" refer to the relative size of the bore diameters during use of the tool and do not indicate radial expansion or contraction during use (although such may occur).

The sliding sleeve assembly 83, having sliding sleeve 84, is positioned and mounted for movement between the housing 62 and the mandrel 72. A first annulus 92 is defined between the sliding sleeve and the tubular housing, and a second annulus 94 is defined between the sliding sleeve and the mandrel. A portion of the exterior surface of the sleeve defines a metal sealing surface 106 for sealing contact with the radially reduced portion 86 of the tubular housing bore.

The sliding sleeve 84 is mounted for axial movement between an initial position, seen in FIG. 3, wherein the metal sealing surface 106 is longitudinally adjacent the radially reduced portion 86 of the tubular housing bore (although not sealed against the bore), and an open or disengaged position, seen in FIG. 4, wherein the metal sealing surface 106 is longitudinally adjacent the radially enlarged portion 88 of the tubular housing.

The sliding sleeve 84 has a body 95 designed to be elastically, radially expandable between a radially unexpanded state, seen in the Figures, and a radially expanded, sealed state in response to a pressure differential across the first annulus 92 and second annulus 94. The sliding sleeve body is preferentially thin-walled along much of its longitudinal extent. The thin walled portion radially expands in response to a selected pressure differential. That is, when pressure in the second annulus 94 and especially along the annular cavity 96 exceeds pressure in the first annulus 92 exterior to the thin-walled portion, the wall 98 radially expands. In the radially expanded position, the sealing surface 106 sealingly engages the housing bore wall along its radially reduced portion 86. However, when the sliding sleeve is moved to an open or disengaged position adjacent the radially enlarged portion 88 of the bore of the housing, as seen in FIG. 4, the sealing surface no longer contacts the bore. In this position fluid is free to flow along the first annulus and past the sliding sleeve. Preferably, when contact is broken, there is rapid pressure equalization across the annular seal (above and below).

On the exterior surface of the sliding sleeve is mounted one or more circumferentially continuous, metal rings 110. In a preferred embodiment, the metal rings 110 are mounted in corresponding slots or grooves 111 defined in the exterior surface of the sliding sleeve. In a preferred embodiment, four rings 110 are employed, however, fewer or more can be used. In the preferred embodiment, the rings are flush with the exterior surface of the sliding sleeve. That is, the OD of the rings is the same as the OD of the sleeve.

The rings 110 act as an annular fluid flow restrictor, or partial seal. That is, they provide a relatively high resistance to flow along the first annulus while still allowing purposeful "leakage," or selectively slow fluid flow, along the OD of the rings (in the annulus between rings and tubular housing) when a selected pressure differential exists across the rings. The pressure differential is typically provided by pulling on the mandrel while the workstring beneath the mandrel is prevented from moving uphole due to any of numerous conditions, colloquially referred to as being "stuck." Alternate methods of creating such a pressure differential are well known in the art. Consequently, the flow restrictor can take various shapes and forms, such as annular washers, annular rings of various cross-sectional shape, a coil or spiral, etc.

The sliding sleeve defines a sleeve base 100 which substantially, but not sealingly, fills the annular space between mandrel 72 and housing 62. The sliding sleeve base 100 annularly abuts an upper surface 101 of metering valve 82. A face seal is provided at the abutment of base 100 and upper surface 101 by means and methods known in the art. In one embodiment, face-seal elements are positioned to create, enhance, or enable the face seal. The face seal prevents radial fluid flow between the sleeve and valve.

The annular metering valve 82 is positioned between the housing 62 and mandrel 72. The first annulus 92 extends between the valve exterior and the tubular housing 62. The metering valve defines a profile 102 which cooperates with corresponding profile 104 on the mandrel. The metering valve 82 receives fluid flow from the second annulus on the ID of the sliding sleeve 84. Fluid is directed through passageways 112 defined in the valve body. The passageways have positioned therein hydraulic resistors 113 which provide a selected high resistance to fluid flow. Metering valves, hydraulic resistors and their use are known in the art and will not be discussed in detail herein as they are beyond the scope of this disclosure. Commercially available hydraulic resistors are made by, for example, The Lee Company. Hydraulic resistors are typically designed for clean hydraulic systems, such as for braking and power transmission systems. An exemplary hydraulic resistor type is referred to as a "viscojet" since they reduce the system timing's dependence on the viscosity of the fluid, which changes with temperature. In a preferred embodiment, fluid is vented to the first annulus 92 through discharge port 114, as shown.

The metering function of the valve works to resist upward pull on the mandrel, thereby creating strain in the tool string above the jar tool assembly. However, the metering valve allows a controlled, relatively slow, fluid flow against high resistance. Consequently, the valve and abutted sleeve are slowly slid in the direction of the mandrel pull. The temporary resistance provided by the metering valve essentially acts as a hydraulic time-delay system, the purpose of which is to heighten the strain energy of the tool string above and increase the magnitude of the subsequent internal collision in hopes of freeing the "stuck" tool string.

For further disclosure regarding metering valves, see the catalog, available on-line at Halliburton.com, *Halliburton Test Tools,* 5-7 and 5-42-43 (Halliburton Energy Services, Inc. 2012), which is incorporated herein by reference in its entirety for all purposes. Metering valves are used in, for example, Halliburton Energy Services, Inc. tools such as the Sperry-Sun Sledgehammer (trade name) Jar series, the Lock-Jar coiled-tubing and slickline-deployed jar, and Select (trade name) and Omni (trade name) tools.

The sliding sleeve, annular seal assembly 76 is positioned in the wellbore as part of a tubing string, the sliding sleeve assembly mounted for axial movement in a substantially tubular housing. At this point, the sliding sleeve is not sealed against the housing wall. The mandrel 72 is pulled upward from the surface while the housing 62 remains stuck in position. The mandrel, and uphole tools and tubing attached thereto, are placed in strain or "stretched." As the mandrel 72 moves upward, it drags along metering valve assembly 82 via cooperating profiles 102 and 104. The metering valve assembly 82, at its upper surface 104 abuts and seals against the lower surface of the base 100 of the sliding sleeve 84. The mandrel, valve assembly and sleeve assembly are moved upward. A pressure differential is created across (above to below) the seal assembly such that fluid will attempt to flow through any available path from above the seal assembly to below it.

Consequently, fluid flows along first annulus 92, on the OD of the sleeve, between sliding sleeve and housing, including past the plurality of flow restrictors 110. The flow restrictors 110 are metal, and preferably annular rings mounted in corresponding grooves 111 defined on the exterior surface of the sliding sleeve. The fluid restrictors 110 restrict fluid flow, applying a resistance to such flow, but are designed to allow a selected flow-through.

Similarly, fluid attempts to flow through the second annulus 94, on the ID of the sleeve, between sleeve and mandrel. Fluid pressure builds within the second annulus 94 and in the annular cavity 96. Fluid is allowed to flow, against a relatively high resistance, along the second annulus. In particular, the fluid flows through the annular cavity 96, between the base 100 of the sleeve 84 and the mandrel, and into passageways 112 defined in the metering valve assembly 82. The metering valve assembly includes one or more hydraulic flow resistors 113. Such resistors are known in the art and create a high resistance to flow while allowing a metered volume of flow therethrough at a given pressure differential across the valve. The resistance to flow along the second annulus—along annulus 94, through cavity 96, and through metering valve 82 and hydraulic resistors 113—is higher than the resistance to flow along the first annulus 92—along the OD of the sleeve and past the fluid resistors 110 mounted thereon. This difference in flow resistance results in an annular pressure differential between the OD and ID annuli of the sleeve.

The pressure differential causes the thin walled portion 98 of the sleeve to radially expand. In turn, the radial expansion causes the annular sealing surface 106 to engage the interior surface of the housing 62. The sealing surface creates an annular, metal-to-metal, fluid-tight seal. After the annular seal is created, fluid continues to flow through the metering valve assembly. The mandrel, still being pulled upward, drags the metering valve and sliding sleeve upward through the housing. The sliding seal surface drags along the housing surface, maintaining a fluid-tight seal. The impact mandrel 74, positioned just above the sliding sleeve, is also moved upwards. The metering valve regulates the speed of the movement, the force necessary to create the movement, etc. The metering valve acts as a time-delay mechanism in activation of the impact of the jar tool.

As seen best in FIG. 3, the mandrel 72, valve assembly 82, sliding sleeve seal assembly 84, and impact mandrel 74 are pulled upward against the drag created by the metering valve, until the sliding sleeve seal assembly reaches an open position. In the open position, the sliding sleeve seal moves into the enlarged bore portion 88 of the housing. Consequently, the seal between the sealing surface 106 of the sliding sleeve assembly is disengaged. The annular pressure differential across the sliding sleeve is released and the thin-walled portion 98 returns, elastically, to its original, radially contracted position. Fluid is free to flow, relatively unrestricted, down the first annulus. The pressure differential above and below the sliding sleeve assembly is equalized. The mandrel above the sliding sleeve seal, which has been stretched and strained, is now free of gripping engagement of the housing and very rapidly "shrinks" or longitudinally contracts. This contraction causes the impact mandrel 74 to move upward rapidly until the impact mandrel shoulder 75 impacts cooperating shoulder 77 of the impact nipple 76.

The jarring impact is designed to break loose the tools stuck in the wellbore below the jar tool assembly. If, however, the first impact does not free the work string, the process is repeated. The mandrel string is moved downward by the operator, the sliding sleeve assembly moves back into the radially reduced portion of the housing bore, and the tool is re-set for another iteration. The restriction rings 110, made of metal and designed to survive the extreme forces placed on them during operation, slide back into the radially reduced portion of the housing and are operable for additional iterations of the procedure. Similarly, the sealing surface 106 of the sliding sleeve is undamaged and is returned to its initial position in the radially reduced portion of the bore.

The invention allows the metal-to-metal seal to occur at high temperatures and pressures, even where the viscosity of most fluids is reduced such that an annular pressure differential across the sliding sleeve (between first and second annulus) could not occur in conventional designs. This enables reliable cycling of high-temperature, high-pressure tools and seals in situations where conventional seals suffer damage and where a metal-to-metal cup seal would fail (without a very high viscosity fluid being used).

Exemplary methods of use of the invention are described, with the understanding that the invention is determined and limited only by the claims. Those of skill in the art will recognize that some disclosed steps can be omitted or repeated, the order of some steps can be varied, and supplemental steps can be added, while practicing the inventive methods herein described. The inventive method is limited only by the claims.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

It is claimed:

1. A method of repeatedly providing an annular, metal-to-metal seal between a metal, annular sliding sleeve and a metal tubular housing in a wellbore extending through a subterranean formation, the housing defining a bore having radially reduced and a radially enlarged portions, the sliding sleeve mounted for movement in the housing and positioned between the housing and a mandrel, the method comprising:

creating an annular pressure differential across the sliding sleeve between a first annulus between the sliding sleeve and the housing and a second annulus between the sliding sleeve and the mandrel, and providing a first resistance to fluid flow along the first annulus, and providing a second resistance to fluid flow along the second annulus, and wherein the second resistance is higher than the first resistance;

radially expanding the sliding sleeve in response to the annular pressure differential;

sealingly engaging a metal sealing surface against the radially reduced portion of the housing bore in response to the radial expansion of the sleeve;

moving the sliding sleeve axially into the radially enlarged portion of the housing bore;

moving the mandrel when pushing the sliding sleeve by an annular valve mounted on the mandrel;

disengaging the metal-to-metal seal in response to the movement into the radially enlarged portion; and moving the sliding sleeve back to a position in the radially reduced portion of the housing bore.

2. The method of claim 1, further comprising providing the first resistance to fluid flow by resisting fluid flow along the first annulus with a plurality of metal flow resistors mounted on the exterior of the sliding sleeve.

3. The method of claim 2, wherein the metal flow resistors are metal rings or a metal coil.

4. The method of claim 3, wherein the metal flow resistors are mounted in corresponding grooves defined in the exterior of the sliding sleeve.

5. The method of claim 1, further comprising controlling the rate of movement of the sliding sleeve from the radially reduced portion of the housing bore to the radially enlarged portion of the housing bore by flowing fluid through a fluid-metering valve positioned adjacent the sliding sleeve.

6. The method of claim 5, further comprising flowing fluid from the second annulus into one or more passageways defined in the fluid-metering valve.

7. An annular, sliding sleeve assembly for use downhole in a wellbore extending through a subterranean formation, the sliding sleeve assembly comprising:

a mandrel positioned in a substantially tubular housing, the housing having an interior surface defining a bore having a radially enlarged portion and a radially reduced portion;

a sliding sleeve positioned between the housing and the mandrel, a first annulus defined between the sliding sleeve and the housing, a second annulus defined between the sliding sleeve and the mandrel;

the sliding seal defining a metal sealing surface on an exterior surface for sealing contact with the radially reduced portion of the housing bore;

the sliding sleeve mounted for axial movement between a first position wherein the sealing surface is adjacent the radially reduced portion of the housing bore, and a second position wherein the sealing surface is adjacent the radially expanded portion of the housing bore;

the sliding sleeve elastically, radially expandable in response to an annular pressure differential across the first annulus and second annulus;

a plurality of metal fluid flow resistors mounted on the exterior of the sliding sleeve and operable to impart a first resistance to fluid flowing along the first annulus, the fluid flow resistors operable to create the annular pressure differential;

a metering valve positioned adjacent the sliding sleeve and having passageways defined therein for imparting a second resistance to fluid flowing along the second annulus; and a fluid path defined from the second annulus adjacent the sliding sleeve to the passageways of the metering valve.

8. The assembly of claim 7, wherein the first resistance is less than the second resistance.

9. The assembly of claim 7, wherein the metering valve is operable to control the rate of movement of the mandrel within the housing.

10. A method of repeatedly providing an annular, metal-to-metal seal between a metal, annular sliding sleeve and a metal tubular housing in a wellbore extending through a subterranean formation, the housing defining a bore having radially reduced and a radially enlarged portions, the sliding sleeve mounted for movement in the housing and positioned between the housing and a mandrel, the method comprising:

creating an annular pressure differential across the sliding sleeve between a first annulus between the sliding sleeve and the housing and a second annulus between the sliding sleeve and the mandrel, and providing a first resistance to fluid flow along the first annulus, and providing a second resistance to fluid flow along the second annulus, and wherein the second resistance is higher than the first resistance;

radially expanding the sliding sleeve in response to the annular pressure differential;

sealingly engaging a metal sealing surface against the radially reduced portion of the housing bore in response to the radial expansion of the sleeve;

moving the sliding sleeve axially into the radially enlarged portion of the housing bore;

controlling the rate of movement of the sliding sleeve from the radially reduced portion of the housing bore to the radially enlarged portion of the housing bore by flowing fluid through a fluid-metering valve positioned adjacent the sliding sleeve;

flowing fluid from the second annulus into one or more passageways defined in the fluid-metering valve;

disengaging the metal-to-metal seal in response to the movement into the radially enlarged portion; and moving the sliding sleeve back to a position in the radially reduced portion of the housing bore.

11. The method of claim 10, further comprising providing the first resistance to fluid flow by resisting fluid flow along the first annulus with a plurality of metal flow resistors mounted on the exterior of the sliding sleeve.

12. The method of claim 11, wherein the metal flow resistors are metal rings or a metal coil.

13. The method of claim 12, wherein the metal flow resistors are mounted in corresponding grooves defined in the exterior of the sliding sleeve.

14. The method of claim 10, further comprising controlling the rate of movement of the sliding sleeve from the radially reduced portion of the housing bore to the radially enlarged portion of the housing bore by flowing fluid through a fluid-metering valve positioned adjacent the sliding sleeve.

15. The method of claim 10, further comprising moving the mandrel when pushing the sliding sleeve by an annular valve mounted on the mandrel.

* * * * *